United States Patent [19]

Timson

[11] 3,958,532

[45] May 25, 1976

[54] COATING APPARATUS

[75] Inventor: William J. Timson, Belmont, Mass.

[73] Assignee: Polaroid Corporation, Cambridge, Mass.

[22] Filed: July 22, 1974

[21] Appl. No.: 490,253

[52] U.S. Cl. ..... 118/325; 118/412

[51] Int. Cl.[2] ..... B05C 5/02

[58] Field of Search ..... 118/325, 50, 50.1, 300, 118/411, 621, 314, 412, 33, DIG. 24

[56] References Cited

UNITED STATES PATENTS

| | | | |
|---|---|---|---|
| 896,504 | 8/1908 | Adams | 118/412 |
| 1,422,545 | 7/1922 | Dayton | 118/412 |
| 1,857,242 | 5/1932 | Edmondson | 118/412 |
| 2,314,453 | 3/1943 | Mack | 118/325 |
| 2,761,419 | 9/1956 | Mercier | 118/412 |
| 3,502,494 | 3/1970 | Ishiwata | 118/50 X |
| 3,749,053 | 7/1973 | Timson | 118/50 |

*Primary Examiner*—Nile C. Byers

*Attorney, Agent, or Firm*—Sheldon W. Rothstein

[57] ABSTRACT

Coating apparatus for depositing multiple layers of superposed coating compositions onto the surface of a moving web which is substantially flat in the region of application of the coating compositions and wherein the web maintains a substantially gapless relationship to the apparatus.

4 Claims, 2 Drawing Figures

COATING APPARATUS

BACKGROUND OF THE INVENTION

The present invention relates to novel coating apparatus for applying multiple superposed coatings to the surface of a moving web, and more particularly to coating apparatus in which layers of coating solutions cascade onto a moving web and are thereafter set or gelled.

Known cascade coating apparatus is capable of applying a plurality of separate coatings onto the surface of a moving web. The coatings are depositied onto the web from downwardly flowing coating solution lamina, superposed one upon another in a layer relationship, and thereafter gelled, or set, to produce an article having a plurality of substantially discrete superposed layers on the web base. Conventionally, the coating solutions have been applied to the web as the web is being supported by a roller, i.e., the web is curved in the direction of travel at the time of application of the coating solutions. The use of rotating rolls as web supports in combination with a stationary coating head apparatus has met with success; however, there are a number of disadvantages associated with such structures. For example, when attempting to coat at relatively high web speeds, particularly with high viscosity coating fluids, there have been such problems as air bubbles being entrapped under the coatings hereby providing nonuniformity of the coatings. Such problems have been minimized by applying a vacuum to the side of the web which is to be coated as the web passes around the rotating support roll. The use of a vacuum box in this position has to some extent stabilized the "bead" of the coating solution which forms at the point of contact of the coating solution with with the web. However, this approach has not been fully satisfactory due to, for example, the rotating backing roll, variations in flatness of the coating head facing the roll defects in the roll surface, film base flatness variations, etc. Because of the denoted problems, very small, e.g., substantially nonexistent, coating gaps are difficult to obtain on production machines without scraping at some point in the operation. Defects caused by the above cannot be tolerated in products such as photographic films in which substantially uniform coatings are necessary in order to achieve consistently good quality image reproduction.

Typical prior art patents relating to known structures of the type mentioned above are U.S. Pat. Nos. 2,761,419; 3,206,323; and 3,220,877. This invention is related to my invention described in U.S. Pat. No. 3,749,053.

SUMMARY OF THE INVENTION

A primary object of the present invention is to provide a novel cascade coating apparatus which is capable of applying a plurality of superposed coating solutions onto a web at high throughput with a high degree of uniformity and no appreciable gap between the web and applicator.

Another object of the invention is to coat a web while it is travelling in a substantially straight path as distinguished from an arcuate path of web travel around a support roller.

A still further object of this invention is to provide a coating apparatus which may be run at high speed and is capable of coating a high viscosity web-contact layer and a lower viscosity upper layer.

In order to improve film coating stability, particularly at high web throughputs, and to obtain more uniform coatings on the web, a web is passed through what amounts to a substantially gapless coating applicator. Force is exerted upon the web which is to be coated to urge it toward contact with the coating applicator, i.e., upwardly against the coating head to reduce the gap between the coating head and the web. The web should not experience deviations from substantial flatness at the coating composition deposition area and will accordingly be free floating and will not abe supported by a backing roll at the deposition area.

The application of the coating solutions to the web while the web is running in a substantially straight path, in contradistinction to travelling around a support roll, has the advantage that after the coating solutions are deposited upon the web, they are not subjected to immediate bending as in the case with the prior art support rollers where stress is applied to the layers of coating solution due to the arcuate path of movement of the web. It is theorized that the bending of the web carrying the coatings tend to result in nonuniformities in the coatings. For example, upon unbending of the web, the upper surface of each coating will be contracted or compressed relative to the lower surface of the coating, which may result in some of the irregularities found in prior art laminated products. In addition, elimination of the support rolls provide the free-floating functionality aspect necessary to the practice of the present invention.

If it is desired to increase the rate at which the coatings gell upon contact with the web, the web may be precooled by spraying the web with a coolant upstream of the coating applicator.

In addition, in order to accommodate, for example, the passage of a splice in the web past the coating applicator the free floating aspect of this invention permits the web to slightly deviate from its path to accommodate the splice without tearing.

In accordance with one aspect of the invention, a pressure chamber may be provided adjacent the lower portion of the coating head at the point of application of the coatings to the web. The positive pressure provided by this chamber tends to press the web upwardly, thereby reducing, or substantially eliminating, the magnitude of any coating gap in order to achieve uniform coatings. Mechanical tensioning devices are also appropriate.

By employing the present invention, it has been found that persistent problems relating to solution viscosities and coating speeds have been overcome. With the present invention it makes little difference if the viscosity of the first layer is greater than the next layer. In general, the viscosities of materials employed in the first layer may be from one to a thousand or more centipoises. The web speed may be as high as 1,500 feet per minute or more. It is accordingly evident that the present invention provides a substantially viscosity independent multilayer coating apparatus wherein deposition rate and viscosity cease to be the limitations that they now are.

The above and other objects, features and advantages of the invention will become more apparent as this description proceeds.

DETAILED DESCRIPTION OF THE INVENTION

Figure 1:
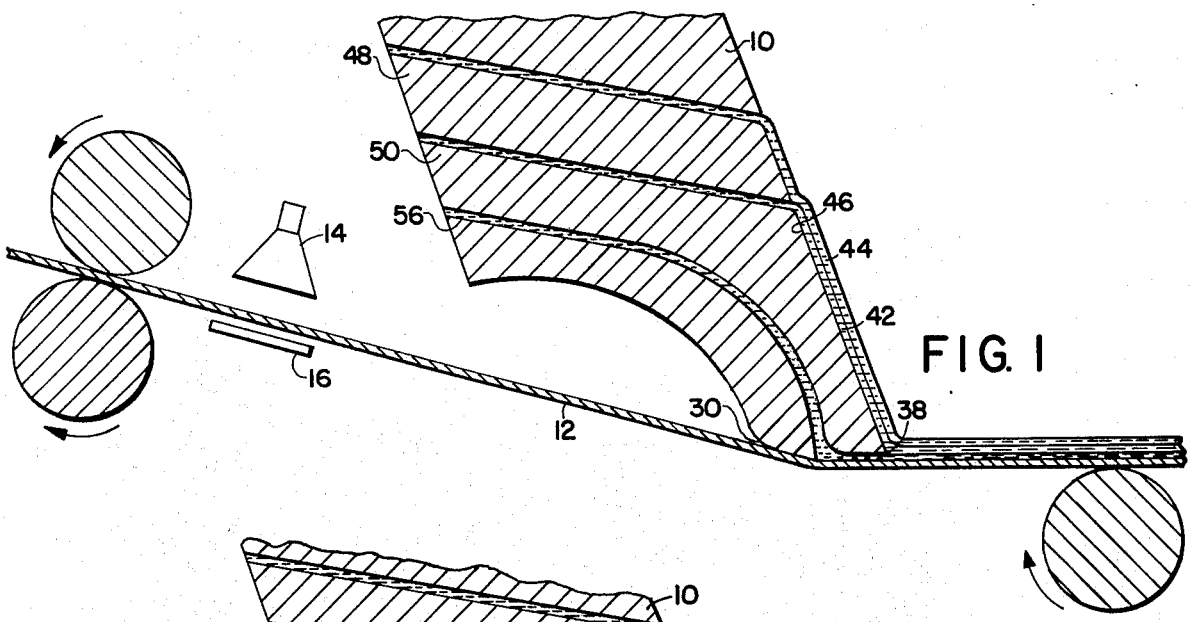
FIG. 1 is a view taken primarily in vertical longitudinal section of a presently preferred embodiment of the invention.

Referring now to the drawings wherein like reference numerals are used in the several views to designate like parts, and more particularly to FIG. 1, reference number 10 generally designates one embodiment of a cascade coating apparatus in accordance with the present invention. A web 12 which may be, for example, a film such as a cellulose acetate, polyethylene terephthalate, etc., initially has its surface cooled with a coolant such as air or preferably a volatile coolant such as methanol or freon from a spray head 14. Excess coolant falling off of the web may be collected in a tray 16 for recycle to the spray head. The web is precooled to a temperature which will expedite the gelling or setting of the coating solutions upon contact with the web in the coating head. It is then introduced to the coating area and passes surface 30 of the coating applicator, which preferably has a rounded leading edge and is at an appropriate angle to contact the web without abrasion, though the applicator may be adjusted so that the web passes close to surface 30 without actually contacting it.

A multiplicity of coating solutions represented in the FIG. 1 embodiment of two superposed layers or strata of coating solutions 42 and 44 flow down the inclined cascade plane outer or downstream surface 46 of the applicator, past lip 38 onto the web 12 where the coating solutions quickly set to form a laminated article. The coating solutions may be, e.g., a silver halide emulsion and a protective gelatin coating which are commonly employed in the manufacture of photographic film. As is well known in the art, the thicknesses of the resulting layers in the laminated article do not necessarily correspond to the thicknesses of the cascading coating solutions. The coating solutions are supplied to the coating head from reservoirs through conduits 48 and 50.

A passageway 56 is utilized to supply the bottom layer of coating solution to the web. This may be a surfactant material, or other material, and facilitates the coating of the main coating solution onto the web 12 by lubricating the web against the applicator area between the deposition point of the bottom layer and the cascade surface of lip 38, which area is generally defined as the coating composition deposition area.

Conventional mechanical tensioning means provides net upward pressure on the web section toward the applicator lip as indicated by the position of the rollers which, in this embodiment, is also the means for moving the web past the applicator. Accordingly, the moving web will tend to be pressed upwardly against the under surface of the coating lip 38 to minimize the gap between the web and the lip, which gap will effectively be equal to the web thickness of the bottom layer of coating material from passageway 56. Normally less than 0.001 inch gap above the web may be maintained. A force of about 15 pounds per square inch is adequate to urge the web toward the applicator.

It is a significant feature of the invention that the web 12 is substantially flat as it passes under the surface 38 and the coating solutions are deposited thereon. The now coated web is then drawn off in a substantially straight line so that the coatings may gell without being subjected to laminar problems which might be the case if the web was moving on a path around a roller as in the prior art. Increased processing speeds are also obtainable by the web arrangement of the invention.

Figure 2:
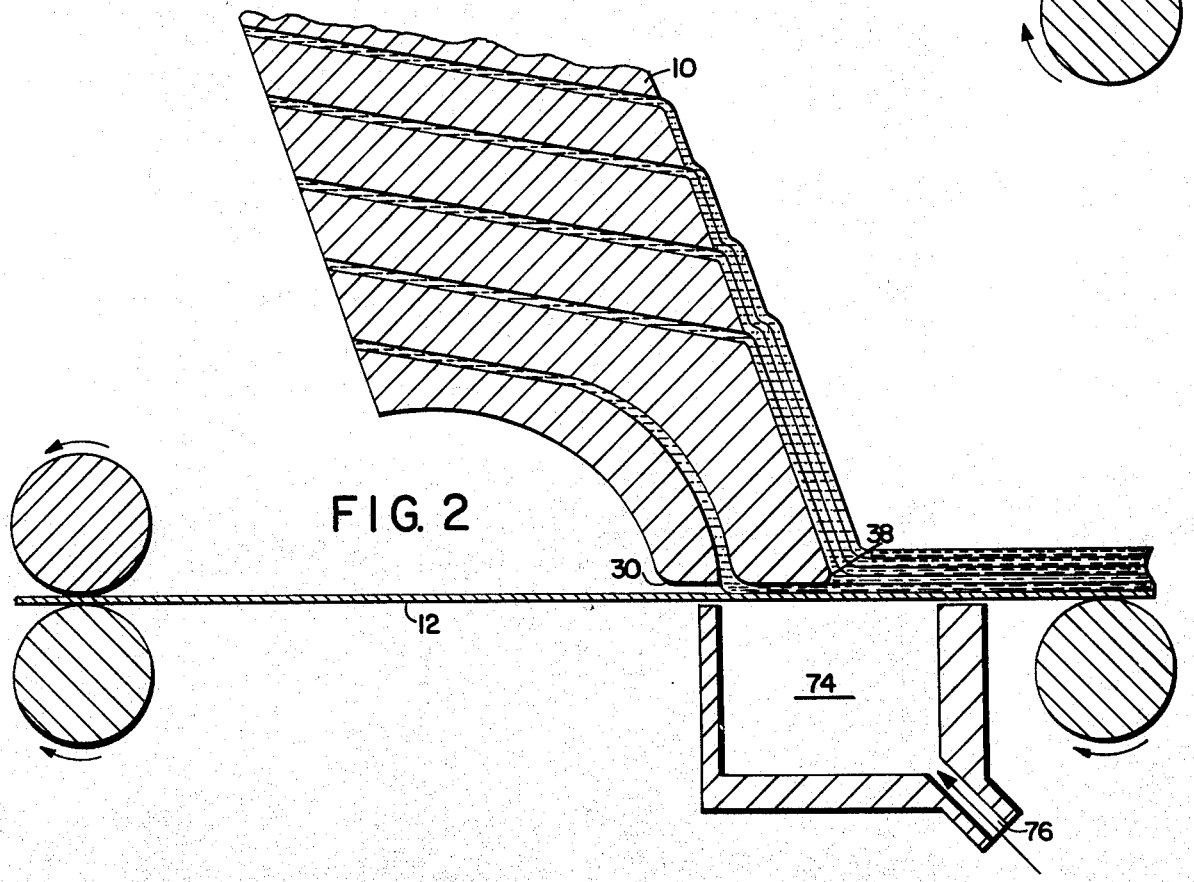
FIG. 2 is a view of another embodiment of the invention.

Referring to FIG. 2, this is a view similar to FIG. 1 but of another embodiment of the invention. In this embodiment air enters chamber 74 through inlet 76 and acts upon the undersurface of the web 12 to urge the web toward the coating lip resulting in a substantially gapless coater as is the case with the FIG. 1 embodiment.

The term "free floating" as employed herein connotes a condition of a web whereby it is free to deviate from its path to accommodate splices, etc.

While presently preferred embodiment of the invention has been shown and described with particularity, it will be appreciated that various changes and modifications may readily suggest themselves to those of ordinary skill in the art on being apprised of the present invention. It is intended to encompass all such changes and modifications as fall within the scope and spirit of the appended claims.

What is claimed is:

1. Web coating apparatus comprising, in combination:

coating composition applicator means including a coating composition deposition portion adapted to deposit at least two discrete continuous layers of coating composition onto a web;

means associated with said applicator means for moving said web past said coating composition deposition portion of said coating apparatus while maintaining said web in a substantially flat, free-floating condition; and means associated with said applicator means for applying a continuous force to said web to urge it toward said coating composition deposition portion of said applicator thereby minimizing the gap between said web and the coating composition deposition portion of said applicator.

2. The invention of claim 1 wherein said means for applying said continuous force to said web comprises a source of positive air pressure exerted against the side of said web opposed to the side to be coated.

3. The invention of claim 1 wherein said applicator means coating composition deposition portion includes a cascade surface along which coating composition is adapted to flow by gravity toward a moving web.

4. The invention of claim 3 wherein said applicator means coating composition deposition portion includes a coating composition deposition means upstream from said cascade surface and adapted to apply a coating composition to the web at a point upstream of said cascade surface.

* * * * *